United States Patent [19]

Morton

[11] 4,374,559

[45] Feb. 22, 1983

[54] APPARATUS FOR HANDLING ARTICLES

[75] Inventor: David C. Morton, Harrogate, England

[73] Assignee: Baker Perkins Holdings Ltd., Peterborough, England

[21] Appl. No.: 227,926

[22] Filed: Jan. 23, 1981

[30] Foreign Application Priority Data

Mar. 12, 1980 [GB] United Kingdom ..... 8008405

[51] Int. Cl.[3] ..... B65G 59/06

[52] U.S. Cl. ..... 198/429; 53/505; 53/542; 198/424

[58] Field of Search ..... 53/505, 542, 540; 198/419–421, 424, 429–430

[56] References Cited

U.S. PATENT DOCUMENTS 3,338,370 8/1967 Maulini ..... 198/421

3,593,837 7/1971 Loomis ..... 198/419

FOREIGN PATENT DOCUMENTS 1379884 1/1975 United Kingdom .

*Primary Examiner*—John J. Love

*Assistant Examiner*—Douglas D. Watts

*Attorney, Agent, or Firm*—Watson, Cole, Grindle & Watson

[57] ABSTRACT

Batches of biscuits are fed to a wrapping machine by a continuously moving infeed conveyor including a series of pusher bars. The batches are fed simultaneously from a number of magazines, disposed alongside the conveyor and pitched closer together than the pusher bars, to a common carrier which then moves to a discharge position above the conveyor. The batches are dropped sequentially from the carrier onto the conveyor under the control of air valves.

5 Claims, 7 Drawing Figures

APPARATUS FOR HANDLING ARTICLES

BACKGROUND OF THE INVENTION

It is usual when automatically feeding batches of biscuits to an intermittently operating infeed conveyor of a wrapping machine to deposit simultaneously a series of batches spaced apart at the same pitch as the pusher bars of the infeed conveyor. An example of such an apparatus is described in British Pat. No. 1379884. A problem, however, arises if it is sought to utilize this procedure with a continuously moving infeed conveyor because, to enable time for depositing and clearance of the depositing means above the batches after depositing into the continuously moving infeed conveyor, the pitch of the pusher bars on the conveyor has to be of the order of 5" or 6" for the normal size range of biscuits. Hence the magazines from which the batches are metered would also need to be spaced apart at this pitch and, as it is quite common for biscuits to be produced in twenty lanes, this leads to a very wide and cumbersome biscuit feeding machine. Furthermore, the width of such a machine makes it difficult for an operator to supervise the machine.

It is an object of the invention to overcome these difficulties by pitching the magazines as close together as practicable irrespective of the pitch of the pusher bars on the conveyor and to programme the depositing of the batches at time-sequenced intervals to coincide with the arrival of the appropriate pusher bar.

SUMMARY OF THE INVENTION

The invention provides apparatus for feeding batches of biscuits from a plurality of magazines spaced equally from one another alongside a continuously moving infeed conveyor leading to a wrapping machine and including a series of pusher bars spaced at a different pitch from the magazines and each serving to advance to the wrapping machine at least one batch of biscuits, the apparatus including a biscuit carrier movable from a receiving position in which it receives batches of biscuits from all of the magazines to a discharge position in which it holds the batches above the conveyor with the batches aligned transversely to the conveyor, means for charging the carrier simultaneously with batches from all the magazines, means for effecting sequential dropping of the batches from the carrier onto the infeed conveyor until all the batches have been dropped, and means for thereafter moving the carrier to the receiving position for recharging it with further batches and returning it to the discharge position to enable the further batches to be dropped for advance by the pusher bars following those which advanced the previous group of batches.

In a preferred embodiment of the invention control of the sequential dropping of the biscuits is effected by air valves operated in sequence by the pusher bars to release jaws holding the batches in the carrier.

Certain embodiments of the invention will now be described in greater detail with reference to the accompanying drawings.

DETAILED DESCRIPTION OF THE PREFERRED EMBODIMENTS

Figure 1:
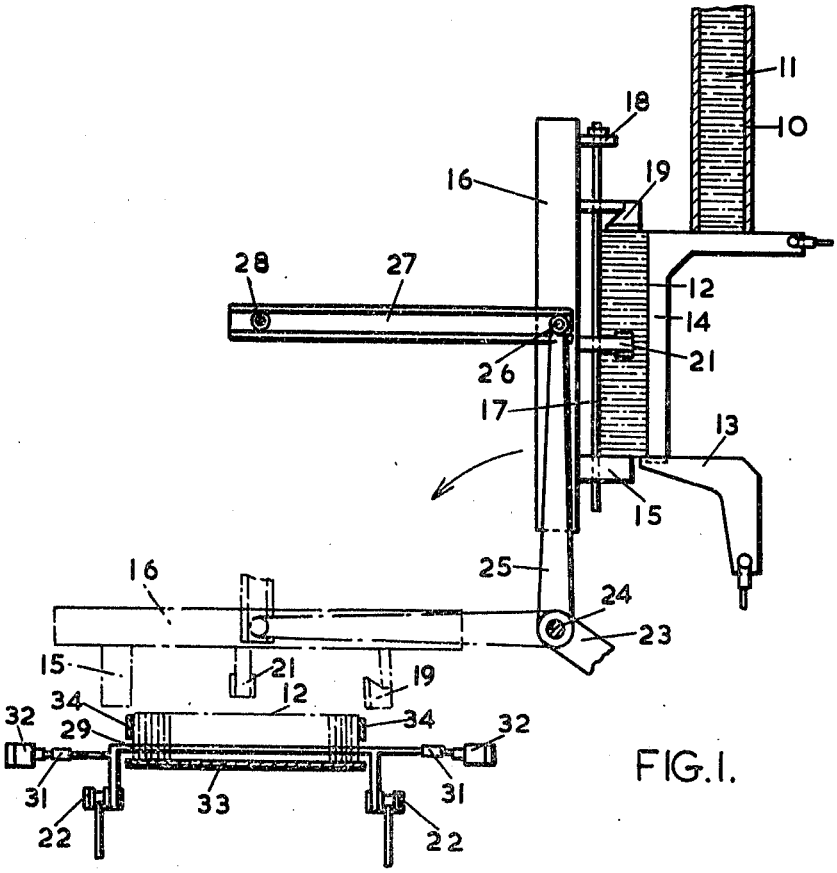
FIG. 1 is a diagrammatic elevation showing the general arrangement of apparatus according to the invention.

As shown in FIG. 1, biscuits to be batched are supplied by means (not shown) to a series of magazines 10 (in the present example ten magazines), each of which supports a vertical column of superposed biscuits 11 and from the bottom of which successive batches 12 of biscuits of a predetermined length are removed. One such magazine only is shown in FIG. 1, but it is to be understood that the magazines are disposed side by side alongside a continuously operating infeed conveyor 22 leading to a wrapping machine (not shown). As more fully described in British Pat. No. 1379884, a movable support 13 is positioned below each magazine 10 and is caused to descend at intervals by an amount equal to the length of the batch 12. The support 13 moves downwardly at substantially the same rate as the biscuits 11 are fed to the upper end of the magazine 10 and upon completion of this downward movement a pusher 14 is operated to slide the batch 12 across the surface of the support 13 on to a platform 15 mounted on a frame 16 common to all the magazines. The pusher 14 moves the batch along the platform 15 until it engages a stop 17 mounted at one end in the platform 15 and at the other end in a bracket 18 mounted in the frame 16.

The frame 16 carries, for each batch 12, a spring-loaded jaw 19 and a pair of spring-loaded grippers 21 which are pivotally mounted on the frame 16 and, upon completion of the transfer stroke of the pusher 14, cam means (not shown) operate to cause each jaw 19 to move into engagement with its respective batch 12 to clamp it on to the platform 15 under the influence of its spring. Such movement of the jaw 19 is also transmitted to the corresponding pair of grippers 21 which simultaneously engage with opposite sides of the batch 12, at approximately the centre of the batch in the longitudinal direction, to provide additional support to the batch.

When all of the batches have thus been securely clamped and centrally supported, the frame 16 is moved to the position shown in chain-dotted lines in FIG. 1 where the batches are positioned above the continuously moving infeed conveyor 22. The mechanism for so moving the frame 16 to this position is as described in British Pat. No. 1379884. It is operated by a cam-controlled arm 23 secured to a shaft 24, to which is fixed a pair of arms 25 on which the frame 16 is pivotally mounted at 26. In operation, the arm 23 is pivoted in an anti-clockwise direction to rotate the arms 25 in the direction of the arrow in FIG. 1. As this occurs a channel member 27 extending from the frame 16 slides along a fixed guide stud 28. Initially the free end of the member 27 moves to the left and upwardly in relation to the stud until the member 27 is in line with the arms 25, whereafter this relative movement is reversed, the member 27 moving downwardly in relation to the stud 28 until the frame 16 takes up the chain-dotted position previously referred to.

Figure 2:
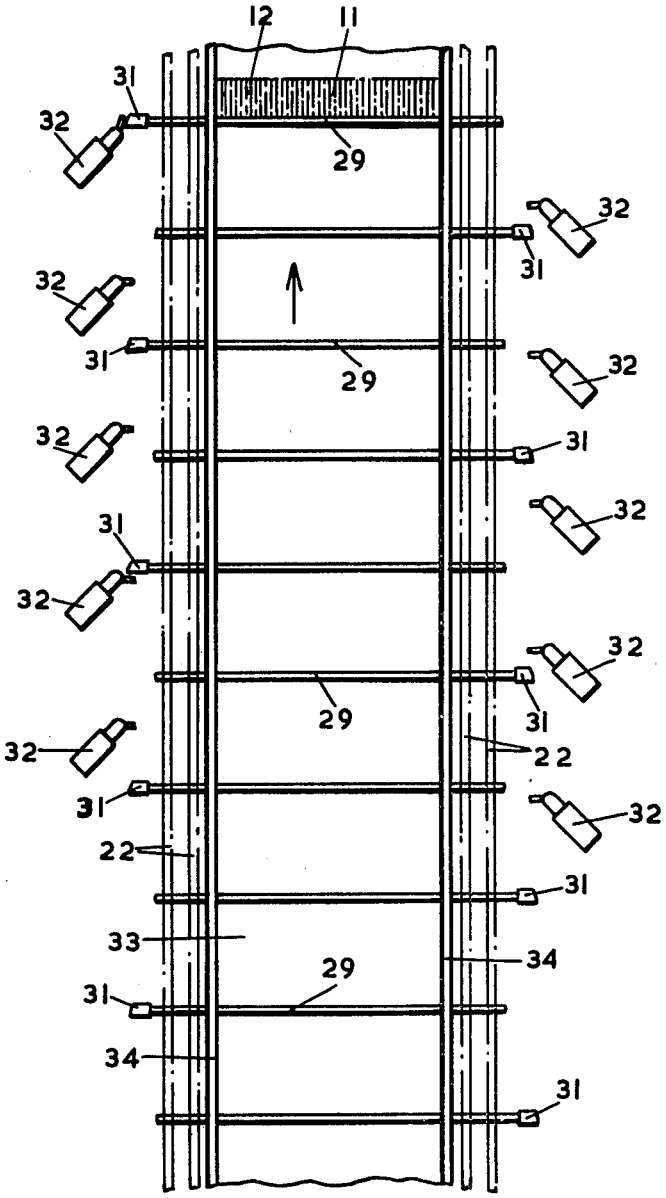
FIG. 2 is a plan of a portion of the infeed conveyor of the wrapping machine.

The conveyor 22 has a series of equispaced pusher bars 29 carrying blades 31 which extend from alternate ends of the bars 29 (see FIG. 2) and in each series of ten bars 29 the blades 31 are arranged at different levels in relation to the longitudinal axes of the bars 29. Arranged on each side of the conveyor 22 adjacent the batches 12 is a series of five air control valves 32, also arranged at different levels in relation to the conveyor 22 and so positioned as to be actuated by respective blades 31 during movement of the conveyor 22. As each blade 31 actuates its respective control valve 32 air under pressure passes through the valve 32 to operate a piston (not shown), mounted on the frame 16, which in turn causes a jaw 19 and the associated grippers 21 to open so as to release their clamping action and allow the associated batch 12 to drop on to a dead plate 33 along which successive batches are transferred by the pusher bars 29 to a wrapping machine (not shown). During this movement the ends of the batches 12 are supported by fixed guides 34. After each batch has been deposited on to the dead plate 33 continued movement of the conveyor 22 causes each blade 31, in turn, to disengage its respective control valve 32 thus cutting off the air supply whereupon the jaw 19 and grippers 21 move, under the influence of their springs, to their closed position.

Figure 3:
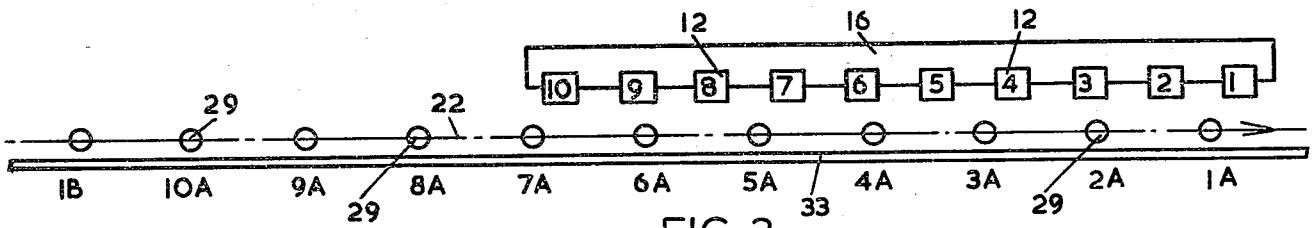
FIGS. 3, 4 and 5 are diagrams illustrating the operation of the apparatus.
Figure 4:
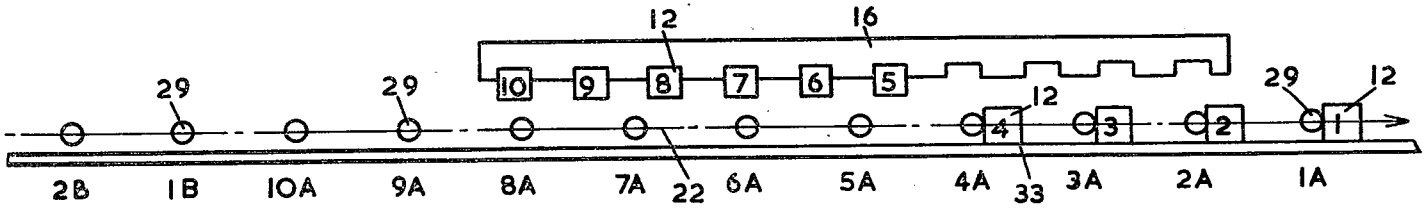
Figure 5:
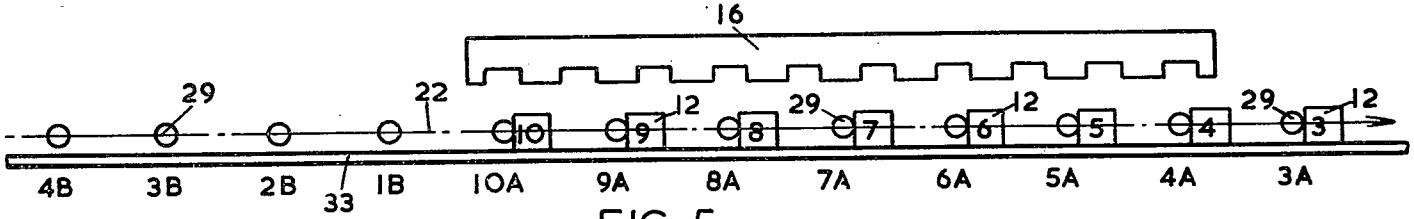

In operation, when ten batches 12 of biscuits have been metered from the magazines 10 and clamped in the frame 16 as mentioned above, the latter transfers the batches to the chain-dotted position previously referred to, i.e. with the batches positioned above the conveyor 22. The timing of this transferring movement is such that as the frame 16 arrives at that position the blade 31 of the first pusher bar 29, in a series of ten bars 29, is about to engage its control valve 32. Upon engagement of the valve 32 the first batch is released from the frame 16 and is transported by that pusher bar 29 along the dead plate 33. During continued movement of the conveyor 22 successive blades 31 in the series engage their respective control valves 32 to release successive batches 12 in sequence from the frame 16. Such sequential deposition is diagrammatically illustrated in FIGS. 3 to 5. FIG. 3 shows the frame 16 containing ten batches 12 in position above the conveyor 22. The pusher bar 1A is about to engage its control valve to effect the depositing of batch 1 on to the dead plate 33. In FIG. 4 batches 1 to 4 have already been released from the frame 16 and are being transported along the dead plate 33 by their respective pusher bars 1A, 2A, 3A and 4A while the pusher bar 5A is about to engage its control valve to release batch 5. FIG. 5 shows the deposition sequence completed with all the batches released from the frame 16 and being transported towards the wrapping machine with the first pusher bar 1B of the next series approaching the depositing position. During the depositing operation just described the pusher 14 is retracted and the support 13 operated to meter a further series of batches from the magazines 10 as described in the above-mentioned British Patent. Upon completion of the depositing of all the batches, the frame 16 is returned to the batch-receiving position and, as it approaches this position the cam means mentioned above causes the jaws 19 and the grippers 21 to open in readiness to receive the metered batches 12 from the support 13. When the batches have been transferred on to the platform 15 by the pusher 14 and clamped by the jaws 19 and grippers 21 the cycle is repeated to deposit these batches on to the dead plate 33 in sequence along which they are transported to the wrapping machine by the pusher bars 1B to 10B respectively.

Figure 6:
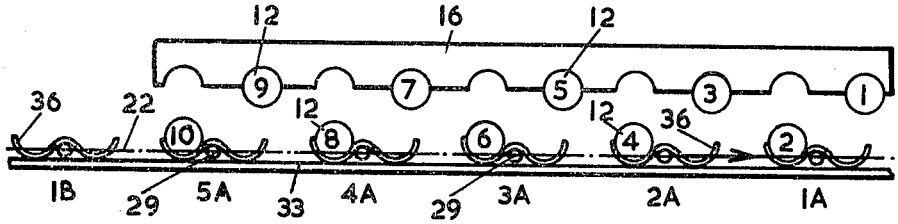
FIGS. 6 and 7 are diagrams illustrating alternative arrangements of the apparatus.

In the alternative arrangement illustrated in FIG. 6, the ten batches 12 are sequentially deposited into a series of five twin-compartmented trays 36 during each cycle of operation, the trays 36 being located alongside the pusher bars 29 on the conveyor 22. The pitch of the compartments in each tray 36 in this example is less than the pitch of the batches 12 in the frame 16. Each pusher bar 29 is provided with a blade 31 at each end and, as the trays 36 approach the depositing position, the blades 31 on one end of the pusher bars 29 engage their respective control valves 32 to release the batches 2, 4, 6, 8 and 10 and deposit them simultaneously into the rear compartments of the trays 1A to 5A respectively. During continued movement of the conveyor 22 the blades 31 on the other ends of the pusher bars 29 engage their respective control valves 32 to release the batches 1, 3, 5, 7 and 9 and deposit them simultaneously into the front compartments of their respective trays 36.

Figure 7:
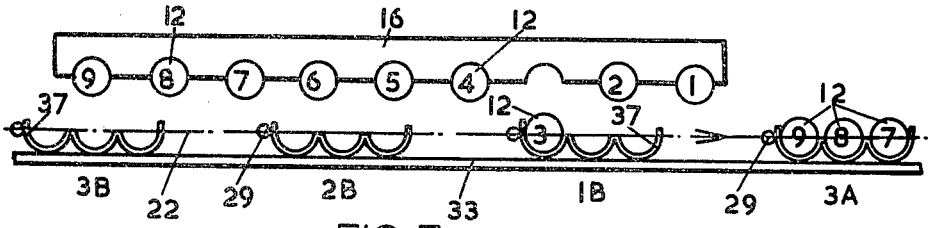

In the further alternative arrangement illustrated in FIG. 7, nine batches 12 are sequentially deposited into a series of three trays 37 during each cycle of operation, each tray 37 being formed with three compartments. The trays 37 are transported along the dead plate 33 by the pusher bars 29 and the blades 31 extend from alternate ends of the pusher bars 29, each blade 31 engaging in turn a corresponding series of three control valves 32. In this arrangement the sequence of deposition of the batches is 3, 6, 2, 9, 5, 1, 8, 4 and 7 for each cycle, this being the order in which each compartment of the respective trays 1B, 2B and 3B aligns with its respective batch in the frame 16 during movement of the conveyor 22.

It will also be appreciated that whilst pneumatic means have been described for controlling the release of the batches 12 from the frame 16 in timed relationship with the movement of the conveyor 22, other control devices, e.g. electrical, responsive to approach of the pusher bars may be utilized to control the release of the batches.

As a further alternative, the release of the batches may be controlled by means which does not sense the approach of the individual pusher bars, e.g. by a photoelectric cell unit activated by the frame 16 as it approaches the depositing position. In this instance it will not be necessary to drop batch 1 (FIG. 3) in front of pusher bar 1A but the unit may, on start up, drop batch 1 in front of any pusher bar and subsequently drop successive batches in front of the first empty pusher bar. This type of dropping system does not require the length of the conveyor to be such that it has to be equally divisible by the number of batches in the frame 16.

I claim:

1. Apparatus for feeding batches of biscuits from a plurality of magazines spaced equally from one another alongside a continuously moving infeed conveyor leading to a wrapping machine and including a series of pusher bars spaced at a different pitch from the magazines and each serving to advance to the wrapping machine at least one batch of biscuits, said apparatus including a biscuit carrier movable from a receiving position in which it receives batches of biscuits from all of the magazines to a discharge position in which it holds the batches above the conveyor with the batches aligned transversely to the conveyor, means for charging the carrier simultaneously with batches from all the magazines, means for effecting sequential dropping of the batches from the carrier onto the infeed conveyor until all the batches have been dropped, and means for thereafter moving the carrier to the receiving position for recharging it with further batches and returning it to the discharge position to enable the further batches to be dropped for advance by the pusher bars following those which advanced the previous group of batches.

2. Apparatus according to claim 1, wherein each pusher bar engages and advances a single batch of biscuits.

3. Apparatus according to claim 1, wherein the pusher bars engage and advance trays, each of which has compartments for receiving at least two adjacent batches.

4. Apparatus according to claim 1, which includes control devices disposed alongside the infeed conveyor for sensing the approach of the pusher bars and operative to control the sequential dropping of the batches from the carrier.

5. Apparatus according to claim 4, wherein the control devices are valves operated in sequence by the pusher bars to release jaws holding the batches in the carrier.

* * * * *